United States Patent [19]

Lai

[11] Patent Number: 4,964,645

[45] Date of Patent: Oct. 23, 1990

[54] RACKET HANDLE

[75] Inventor: Genhone Lai, 1F., No. 46, Alley 3, Lane 187, Sec 3, Cheng Kung Rd., Taipei, Taiwan

[73] Assignee: Genhone Lai, Taipei City, Taiwan

[21] Appl. No.: 372,570

[22] Filed: Jun. 28, 1989

[51] Int. Cl.[5] ..... A63B 49/08

[52] U.S. Cl. ..... 273/73 J; 273/75

[58] Field of Search ..... 273/75, 73 J, 81 R, 273/81 B, 81.4, 81.6

[56] References Cited

U.S. PATENT DOCUMENTS

| | | | |
|---|---|---|---|
| 2,083,872 | 6/1937 | Siegel | 273/81 R |
| 2,775,455 | 12/1956 | Liberti | 273/81.4 |
| 3,295,850 | 1/1967 | Garrity | 273/81.4 |
| 3,782,725 | 1/1974 | Giambazi | 273/81 B X |
| 3,995,856 | 12/1976 | Hollendorfer, Jr. | 273/75 |
| 4,717,152 | 1/1988 | Kessler | 273/75 |
| 4,736,950 | 4/1988 | Doyle | 273/75 |
| 4,836,544 | 6/1989 | Lai | 273/75 X |

FOREIGN PATENT DOCUMENTS

| | | | |
|---|---|---|---|
| 3132487 | 3/1983 | Fed. Rep. of Germany | 273/73 J |
| 3726753 | 2/1989 | Fed. Rep. of Germany | 273/73 J |
| 2232337 | 1/1975 | France | 273/75 |
| 8902297 | 3/1989 | World Int. Prop. O. | 273/73 J |

*Primary Examiner*—Edward M. Coven
*Assistant Examiner*—William E. Stoll
*Attorney, Agent, or Firm*—Bacon & Thomas

[57] ABSTRACT

This invention relates to a structurally-improved racket handle designed to increase the area of the palm in contact with the racket handle thereby allowing a better grip than presently available racket handles. This affords greater power transfer while returning serves, volleying, serving, and other strokes due to the provision of an oblique surface 11 cm. in length that extends from the bottom end of the racket handle in alignment with its central axis and is beveled from the butt in a graduated, constant, or curved manner. The resulting graduated, constant, or curved surfaces yields a naturally formed wedge-shaped edge that fits snugly into the muscles and bones of the palm and muscles of each finger, and enables the palm to naturally assume a tight, circular, yet comfortable grip. The graduated, constant, or curved surfaces that slant upward from the butt of the racket handle offer support to the hypothenar eminence, os pisiforme, and hamulus oss'a hamate against pressure generated during play, making it easier to maximize serving power and other techniques.

5 Claims, 7 Drawing Sheets

A - A

B - B

C - C

D - D

RACKET HANDLE

BACKGROUND OF THE INVENTION

This invention consists of a type of structurally-improved racket handle specifically offering improvements over presently available versions that fit loosely against the palm (due to areas of no contact) leading to a loose grip and loss of power application through the addition of a type of hand and finger support base wherein the muscles of the palm and hypothenar eminence are able to grasp the racket handle naturally, resulting in automatic grip adjustment for the tightest grip possible in the hand of the tennis player as well as ease of stroking powerfully due to the efficient and improved structure of this new type racket handle.

Racket sports require high levels of aggressive physical technique and, from the standpoint of racket sport skills, racket sport players focus mainly on how to perfect the returning of serves, volleying, and serving. As is commonly known, a racket makes contact with the human body at several points, including the fingers, palm, wrist, forearm, upper arm, and shoulder. Of these, the fingers, palm, and wrist have the most direct contact during usage (actual contact area). Since the index finger exerts the most pressure on the handle of sports rackets, it is the key determining factor in whether or not a secure grip is attained. In other words, it affects power control and the degree of success in the execution of technique. It is generally understood that the inability of the hand and fingers to grasp firmly during training or competitive matches influences the execution of technique since the forearm is inhibited from generating solid hitting power or even subjected to a number of sports injuries. Thus the creative motive of the invention herein was based on overcoming the shortcomings of conventional racket handles as previously described above by providing a type of racket handle that naturally accommodates the surface of the palm firmly, while offering a circular grip for the hand and fingers which is comfortable and allows users to easily apply strength with precision due to the improved structure of the racket handle.

SUMMARY OF THE INVENTION

Thus, with respect to the type of structurally-improved handle of the invention herein, the most important aspect of the same racket handle is the 11 cm. (the width of the palm) surface extending from the bottom end of the racket handle in alignment with its central axis and beveled from the butt in a graduated, constant, or curved manner, forming a wedge-shaped edge on the side opposite to the face of the racket. When holding the racket handle, this edge fits naturally into the palm and hypothenar eminence, while permitting a circular gripping posture that is firm and comfortable, enabling users to easily achieve an enhanced degree of control when returning serves, volleying, and serving, with excellent hitting power attainable during the execution of these and other racket sport techniques.

The objectives attained by the invention herein as described above include improvements to practical technique, hand control, and overall efficiency as clearly illustrated in the detailed diagrams below and will present a deeper and fuller understanding of the merits of the racket handle introduced herein.

DETAILED DESCRIPTION OF THE PREFERRED EMBODIMENT

Prior to introducing the invention herein, the handle structure of presently used sports rackets must be explained in terms of points of needed to provide a relative basis of contrast, fuller understanding, and recognition of the unique merits of the invention herein.

Figure 1B:
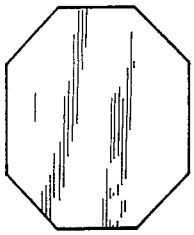
FIG. 1B PRIOR ART
FIG. 1B is an end view of a known racket handle taken in the direction of arrow I in FIG. 1A.
Figure 1A:
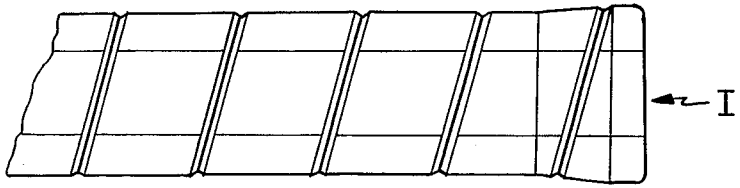
FIG. 1A PRIOR ART
FIG. 1A is a partial side view of a known racket handle.
Figure 2:
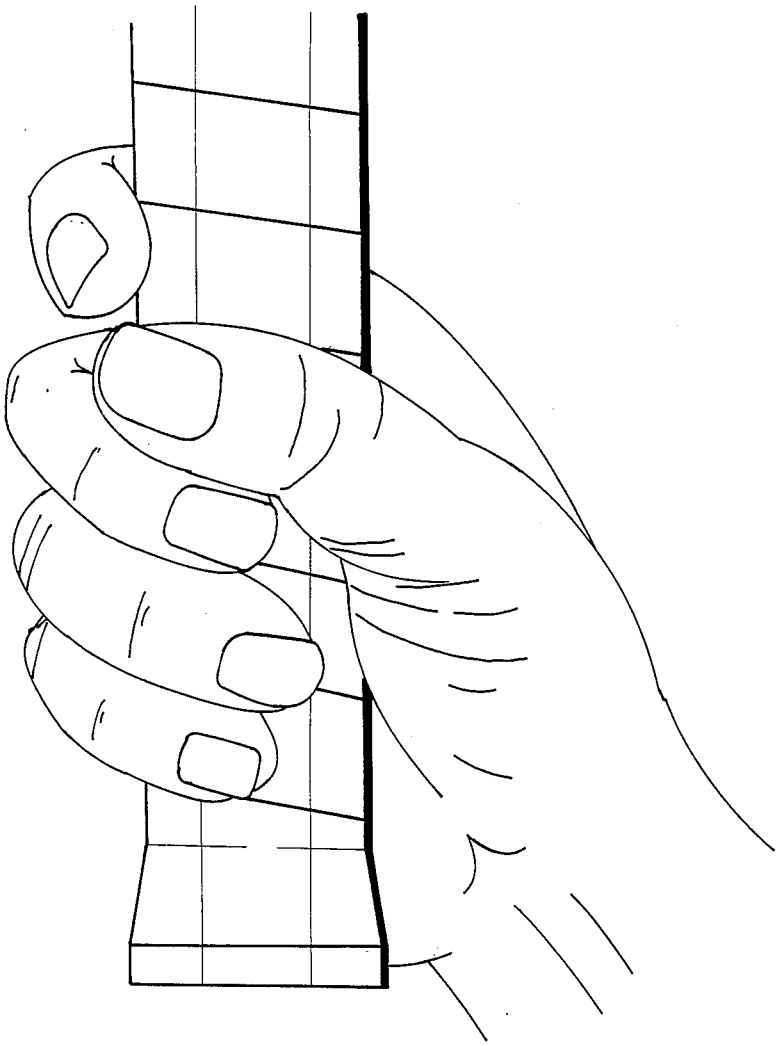
FIG. 2 PRIOR ART
FIG. 2 is a partial view a hand grasping the known racket handle of FIGS. 1A and 1B.
Figure 3A:
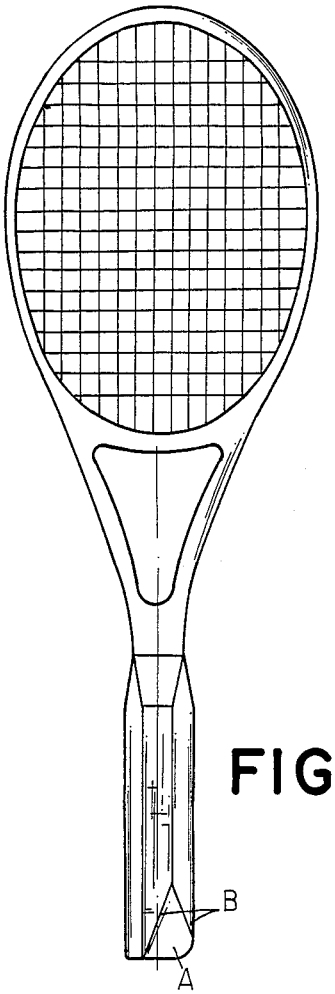
FIG. 3A is a front view of a racket incorporating a handle according to the present invention.
Figure 3B:
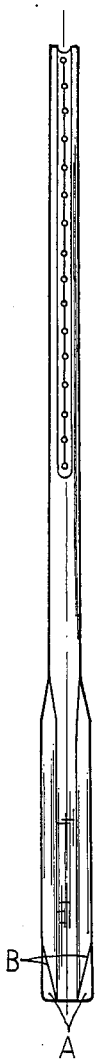
FIG. 3B is a side view of the racket shown in FIG. 2A
Figure 3C:
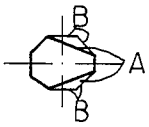
FIG. 3C is a bottom view of the racket shown in FIGS. 3A and 3B.
Figure 4:
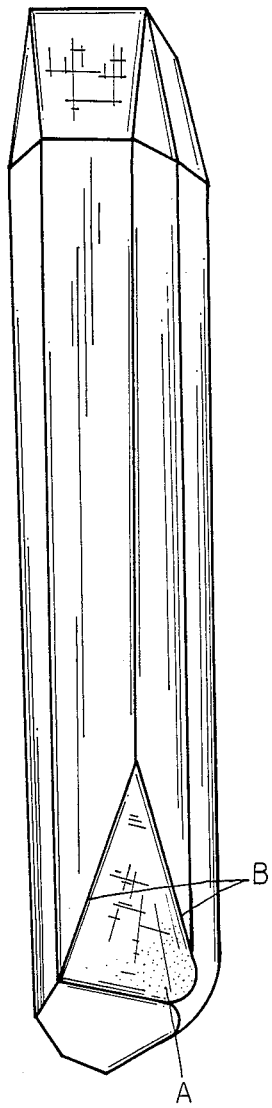
FIG. 4 is a perspective view of the racket handle according to the present invention.
Figure 5:
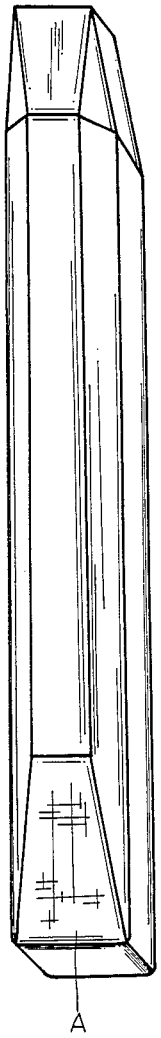
FIG. 5 is a perspective view of the sloping surfaces according to the present invention.
Figure 6A:
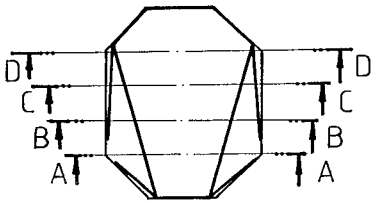
FIG. 6A is an end view of the racket handle according to present invention.
Figure 6B:
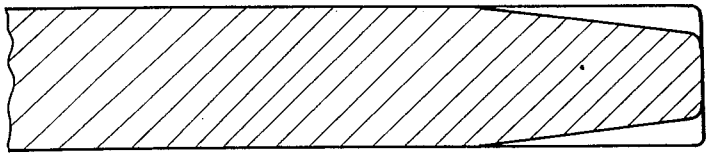
FIGS. 6B–6E are cross-sectional view taken along lines A—A through lines D—D, respectively, in FIG. 6A.
Figure 6C:
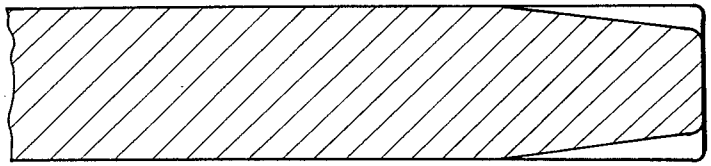
Figure 6D:
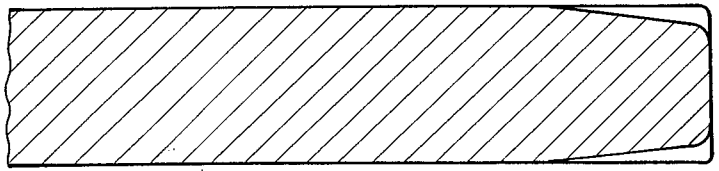
Figure 6E:
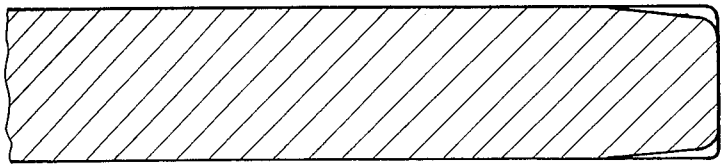
Figure 7:
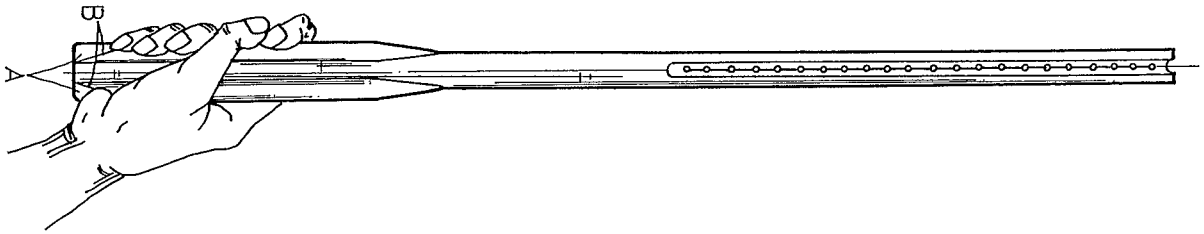
FIG. 7 is a side view of a hand grasping a racket having a handle according to the present invention.
Figure 8:
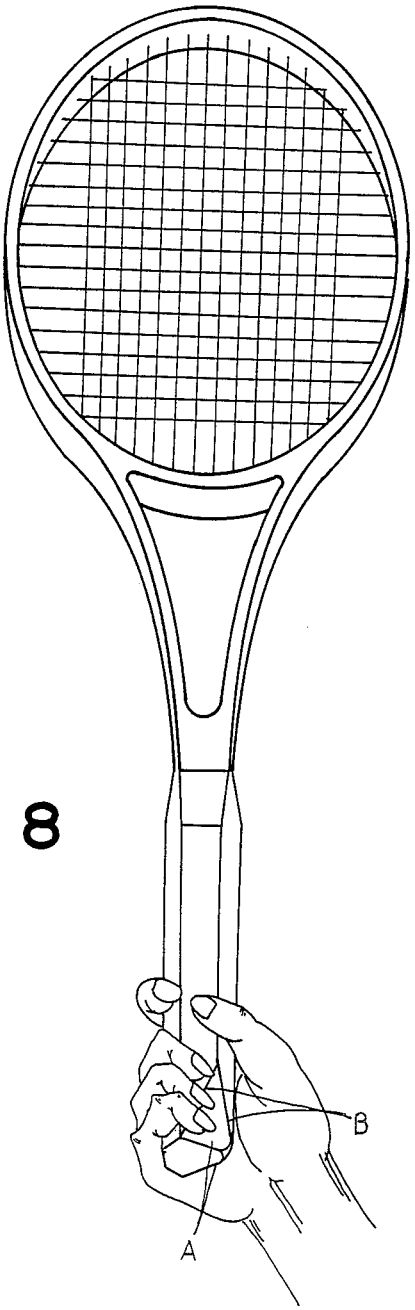
FIG. 8 is a front view of a hand grasping the racket shown in FIG. 7.

FIGS. 1A, 1B and 2 are a depiction of the handle of conventional rackets and typical method of gripping, respectively, and show the raised posturing (at the butt of the racket handle) of the hypothenar eminence and the palm. When a player grasps such a handle, a space can be observed between the surface of the palm and the highest point of the hypothenar eminence inclined towards the hollow of the palm; thus, when partially gripped, the surface portion gradually diminishes and, when completely gripped, the portion between the palm and the bottom end of the racket handle forms a triangulated space resulting in the gradual heightening of the racket in the hollow of the palm, with its highest point, relative to the hollow of the palm, receiving the most impact. To accommodate the raised area, the handle in the palm extends from the hypothenar eminence to face the rear of the hollow of the palm. With this portion, such as in presently used racket handles with a widened butt, the palm tends to be set apart from the racket handle, with no way to achieve a complete and firm grip, leaving most racket sports players with no alternative other than to grip with the fingers rather than solve the problem of partial palm contact with the racket handle, involving compensation through the use of the finger muscles, finger joints, and thumb, which still does not result in the hand and fingers achieving a complete grip of the racket handle. Under these conditions, the palm is disabled from achieving firm contact with the racket handle, with a corresponding decrease in the efficiency of the palm muscles in transferring power and resulting in a relative lessening of delivery power. Because of this situation, the bottom end of the racket handle rises abruptly under the covering, resulting in poor wrist control and difficulty in the wrist exerting power (for example, serving is severly hampered).

FIGS. 3A–3C, 4 and 5 are graphic illustrations of the invention herein (structurally-improved racket handle). With reference to these diagrams, the most important advantage of the invention herein is the addition of an 11 cm. surface (the width of the palm) extending upward from the bottom end of the racket handle in alignment with its central axis, with the A surfaces inclined from the butt in a graduated, constant, or curved manner and achieved by the vertical beveling of the racket handle indicated; thus, the graduated sloped surfaces (depicted in FIG. 6) merge into a single connected curved surface A, resulting in B a wedge-shaped edge oriented towards the face of the racket and formed to fit into the muscles and bones of the hand and palm which, when held, eliminates the occurence of spaces between the palm and the racket handle, a loose grip, and other factors which decrease the efficient transfer of power and related defects. Moreover, the palm is able to grasp the racket in a circular manner that is comfortable due to the improved positioning of the hypothenar eminence on the constant, graduated, or curved surfaces of the invention herein and eliminating excessive strain on the os pisiforme and oss' a hamate in the wrist, which allows an easier ability to maximize both hitting power and technique.

As previously stated above, the invention herein features a structural breakthrough that is practical and efficient, not only in terms of a circularly oriented, comfortable, and tight grip, but also in terms of eliminating spaces between the palm and the racket handle, allowing an appropriately firm grip by minimizing excess pressure on the wrist bones and affording ease of power delivery, all of which leads to improved performance in ball hitting and technique.

What is claimed is:

1. A handle for a racket having a head portion with a generally planar hitting surface, the handle having a first end oriented toward the head portion and a second end oriented away from the head portion and comprising a pair of surfaces formed on the exterior of the handle adjacent to the second end of the handle, one surface located on each side of the plane of the hitting surface, each surface being obliquely oriented with respect to the plane of the hitting surface such that opposite edges of each surface meet to form a vertex pointing generally towards the first end of the handle.

2. The racket handle according to claim 1 wherein the surfaces are each generally triangular in configuration with an edge of the second end of the handle forming the base of the triangle.

3. The racket handle according to claim 1 wherein each of the surfaces is generally planar.

4. The racket handle according to claim 1 wherein the second end of the handle has a cross-sectional configuration of a six side polygon.

5. The racket handle according to claim 4 wherein the cross-sectional configuration of the handle at approximately mid-length is generally octagonal.

* * * * *